United States Patent [19]

Hajdu

[11] 4,221,018

[45] Sep. 9, 1980

[54] LAWN SWEEPER

[76] Inventor: Ferenc Hajdu, P.O. Box 400, Lacomb, La.

[21] Appl. No.: 949,996

[22] Filed: Oct. 10, 1978

[51] Int. Cl.[2] ..... E01H 1/04

[52] U.S. Cl. ..... 15/347; 15/83; 15/386

[58] Field of Search ..... 15/83, 92, 349, 383, 15/386, 354, 347

[56] References Cited

U.S. PATENT DOCUMENTS

| | | | |
|---|---|---|---|
| 857,415 | 6/1907 | Pum | 15/349 X |
| 1,764,666 | 6/1930 | White | 15/354 X |
| 2,052,129 | 8/1936 | Campbell | 15/383 |
| 2,505,576 | 4/1950 | Reitan | 15/386 X |
| 2,678,462 | 5/1954 | Lison et al. | 15/349 |
| 2,834,034 | 5/1958 | Angell | 15/349 X |
| 3,093,853 | 6/1963 | Tamny | 15/83 |
| 3,837,038 | 9/1974 | Kimzey et al. | 15/340 X |
| 4,084,284 | 4/1978 | Hastings | 15/83 X |

*Primary Examiner*—Christopher K. Moore
*Attorney, Agent, or Firm*—C. Emmett Pugh

[57] ABSTRACT

An improved lawn sweeper for clearing a lawn of accumulated debris such as leaves, pine straw, and the like is disclosed. The novel sweeper comprises, in the embodiment shown, an open-bottomed housing holding a rotating cylinder having a number of very strong, flexible wire cable sections bolted to the cylinder. The ends of the wire cable sections have formed thereon a section of tubing pressed flat on the outer ends thereof. The wire cables are mounted in pairs on the cylinder with the flat tubing sections being toed in somewhat in relation to each adjacent pair. The rapidly moving blades create a strong updraft to sweep up accumulated debris with the toe in of the pressed flat tubing sections creating a swirling action which tends to enhance the lifting of the moving air. The ends of the wire cable sections are positioned above the ground by an adjustable distance ranging from one (1) inch to three (3) inches.

13 Claims, 10 Drawing Figures

LAWN SWEEPER

BACKGROUND OF THE INVENTION

This invention relates generally to lawn sweepers and more particularly to a new and novel lawn sweeper which is capable of clearing a lawn of accumulated debris such as leaves, pine straw and the like. The lawn sweeper comprises a novel vacuum forming means which accomplishes the purposes hereinafter specified.

Lawn sweepers and rotating lawn rakes have been utilized in the prior art and accomplish the object intended by the use of rotating brushes, fixed blades, wire sections and other devices attempting to solve the problem of removing accumulated debris from the lawn to the lawn sweeper.

Such devices may be satisfactory for certain types of debris and may not be satisfactory for other types of debris. For example, a prior art lawn sweeper may be satisfactorily designed to pick up lawn clippings but may not be able to pick up twigs or stones. In a similar manner, a lawn sweeper may be designed to be able to pick up debris such as twigs or stones but may not be satisfactorily designed to pick up pine straw or grass clippings.

A detailed prior art search of pertinent lawn sweepers disclosed the following referenced patents which show the great variety of devices available in the market place:

| Patentee | U.S. Pat. No. |
|---|---|
| Streed, et al | 2,755,829 |
| Best | 3,167,899 |
| Stewart | 3,597,910 |
| Rands | 3,696,563 |
| Galvin | 1,493,670 |
| Herold | 2,278,928 |
| Asbury | 2,740,980 |
| Peterson | 2,480,877 |
| Asbury | 2,676,447 |
| Asbury | 2,763,257 |
| Erickson | 2,907,064 |
| Asbury | 3,036,324 |
| Asbury | 3,045,992 |
| Prange | 3,314,095 |
| Walton | 604,812 |
| Whiting | 1,204,220 |
| Reitan | 2,505,576 |
| Ferris | 2,959,904 |
| Lee | 3,304,704 |
| Oblinger | 3,308,612 |
| Schneider et al | 3,518,819 |
| Chouinard | 3,664,099 |
| Dankel, et al | 3,713,284 |
| Palmer | 3,999,316 |

While the above mentioned prior art devices may have proven satisfactory for the individual use intended in the design, it has been found from experience that they would not be satisfactory for use in a large variety of applications such as encompassed within the applicant's device. By the use of the applicant's new and novel lawn sweeper with its new and novel vacuum forming means attached thereto, it is possible to create a strong updraft in the bottom section of the sweeper so that accumulated debris such as leaves, pine straw and other light materials may be quickly picked up and thrown into the sweeper. In addition, the applicant's new and novel lawn sweeper is capable of also cutting grass, weeds, vines, and just about any other thing, living or dead, that is in its path. It is capable of chewing up dead sticks at least up to two and one-half inches in diameter that lie in its path and also will pick up beer cans and other large objects such as that. The subject lawn sweeper does not throw any of the sweepings out of the sides of the unit as does a rotary mower, and it is extremely difficult to get a toe or finger underneath the sweeper which could cause injury to the person's limbs.

SUMMARY OF THE INVENTION

In order to overcome the problems inherent in the prior art type of devices before mentioned, there has been provided by the applicant's invention a new and improved lawn sweeper which is capable of clearing a lawn of virtually any type of accumulated debris from small grass cuttings to large objects and also is capable of removing pine straw from the lawn. This is accomplished by the provision for a rotatable drum positioned within a housing with the drum having a novel vacuum forming means associated with the drum. The drum is rotatable by means of a self-contained motor, and the entire lawn sweeper unit is capable of being moved over the lawn area to be cleaned by means of a plurality of wheels.

The novel vacuum forming means of the invention comprises in the embodiment shown a plurality of elongated lengths of flexible wire cables which are fastened to the rotating drum with each wire cable having an elongated tubing section pressed on one of the ends of the cable to form a substantially flat blade-like weight on the end of the cable. The flat blade-like weights are toed in in relation to adjacent pairs of the weights to provide the improved vacuum forming means which serves to draw the debris to be picked up from the lawn into the lawn sweeper.

The blades also provide a sweeping function and serve to break up any large objects encountered as the debris is swept up and back into the collector bin.

The rotating blades of the vacuum forming means are positioned a predetermined distance above the ground in the range of approximately one inch to three inches more or less in order to prevent injury from the blade contacting the object which it would hit.

However, it should be noted that the blades are extremely sturdy and flexible so that if the blade does contact, say a rock, it will merely bend as it passes it over, causing little if any damage to the blade. In fact, the blades may be positioned to actually come in contact with the ground and the device may then be used as a foliage remover, or even as a grader, and exposed root leveler.

Accordingly, it is an object of the invention to provide a new and improved lawn sweeper which is capable of removing a larger portion of accumulated debris from a lawn than has been heretofore possible.

Another object of the invention is to provide a new and improved lawn sweeper having a new and improved vacuum forming means attached to the lawn sweeper.

Still yet another object and advantage of the invention is to provide a new and improved lawn sweeper which is safe to operate and does not throw debris away from the sweeper when contacted by the rotating sweeping mechanism.

These and other objects and advantages of the invention will become apparent from a review of the drawings of the invention and from a reading of the description of the embodiment shown.

BRIEF DESCRIPTION OF THE DRAWING

For a further understanding of the nature and objects of the present invention, reference should be had to the accompanying drawings, in which like parts are given like reference numerals, and wherein.

DESCRIPTION OF THE PREFERRED EMBODIMENT

Figure 1:
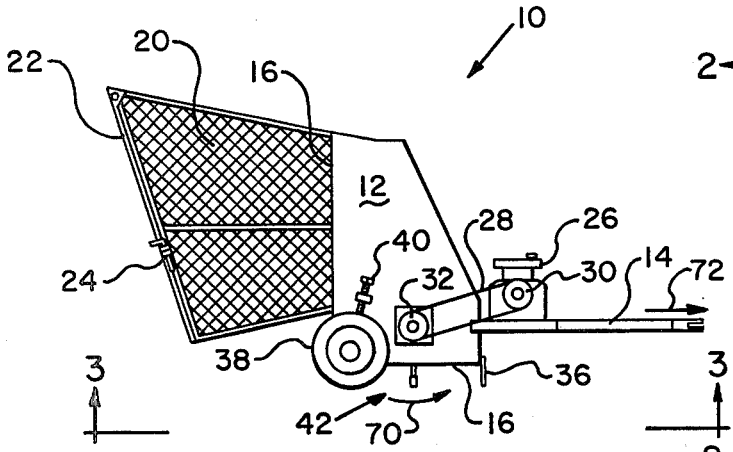
FIG. 1 is a side view of the applicant's new and improved lawn sweeper showing the placement of the rear cage for accumulating debris and also showing the placement of the self contained motor for rotating the drum position within the sweeper.

Referring now to FIG. 1 of the drawing, there is shown the applicant's new and novel lawn sweeper generally by the numeral 10 which is formed with a housing 12 comprising in part a frame 14 and having an open-bottomed section 16 and an open rear section 18 to which is attached a collector bin or cage 20. The collector bin 20 has a pivotable door 22 which is held closed by means of a latch 24 and may be opened by the user of the lawn sweeper to remove the accumulation of debris from the collector bin 20.

The frame 14 carries a self-contained gasoline engine 26 which drives a rotatable drum positioned within the housing 12. The gasoline engine 26 rotates the rotatable drum by means of the belt 28 connected to a pulley 30 on the engine 26 and also to a pulley 32 mounted on a shaft running from the one end of the rotatable drum. A cover (not shown) may be provided for the belt assembly for safety purposes. The rotatable drum is not shown in FIG. 1 of the drawing and by referring to FIG. 3, it can be seen the mounting of the rotatable drum within the open bottom 16 of the sweeper 10. The rotatable drum is shown generally in the drawings by the numeral 34 and will be described more fully hereinafter when referring to FIGS. 3 through 6 of the drawing.

Positioned on the forward portion of the housing 12 is a rubber blade 36 and positioned on the rear portion of the housing 12 is a pair of wheels 38. The wheels 38 are adjustable by means of an adjusting connection 40 as will be described more fully hereinafter. By means of the adjustment 40, the wheels 38 may be raised or lowered to raise or lower the position of the rotating wire cables shown generally by the numeral 42.

Figure 3:
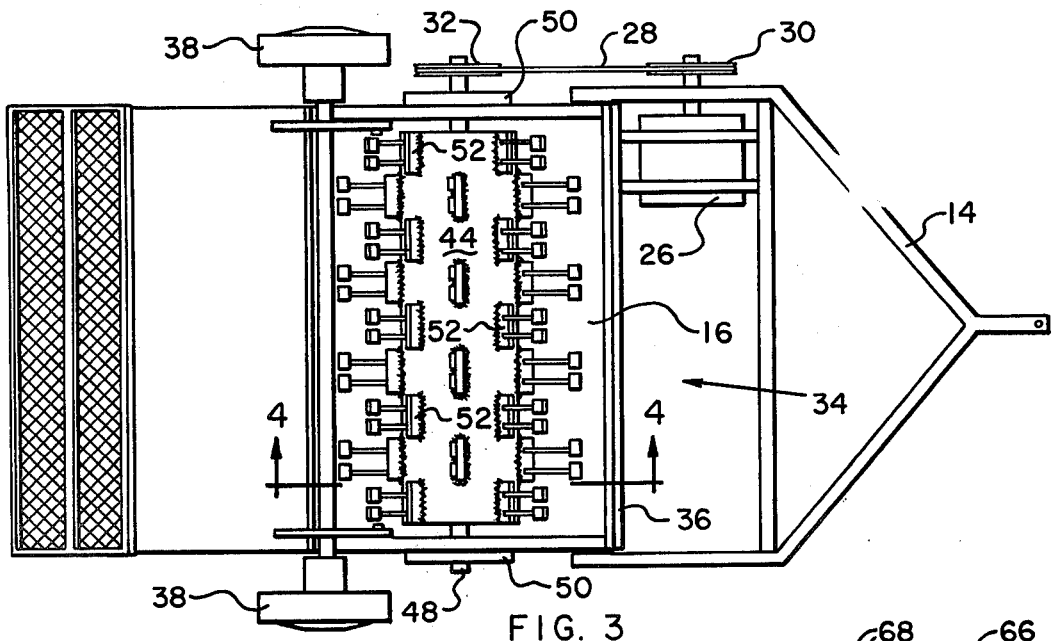
FIG. 3 is a bottom view, taken along line 3—3 of FIG. 1, showing the mounting of the rotatable drum within the housing of the lawn sweeper and also showing the plurality of wire cable sections attached to the drum.
Figure 4:
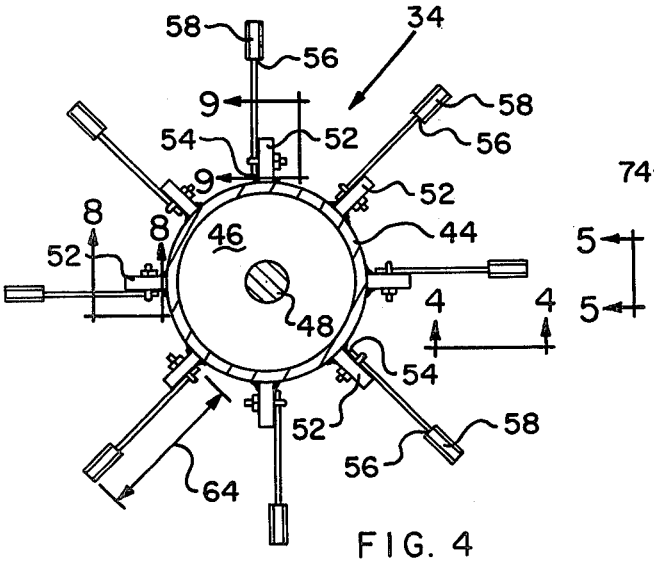
FIG. 4 is a sectional view, taken along line 4—4 of FIG. 3, showing the construction of the rotatable drum and also showing the placement of the plurality of wire cable sections around the drum.

Referring now to FIGS. 3 and 4 of the drawing, there is shown the rotatable drum 34 positioned within the open-bottomed 16 of the subject lawn sweeper. The rotatable drum 34 is formed of a steel circular section 44 having a plurality of ends 46 welded thereto with a central shaft 48 which is carried by a flat plate 50 welded to the side of the housing 12. The central shaft 48 also carries the pulley 32 through which the power to rotate the circular drum is obtained by means of the gasoline engine 26.

By referring now generally to FIG. 3 and FIG. 4 of the drawing, there is shown in more detail the mounting of the vacuum forming means of the subject invention to the rotating drum 44. A plurality of plates 52 are welded to the periphery of the circular drum 44 as shown especially in FIG. 4 of the drawing and the plurality of wire cable sections 42 are attached to the plates. In the embodiment shown in the drawings, there have been formed 8 rows of plates 52 around the periphery of the circular drum 44 with each row of plates having alternately 5 plates and 4 plates attached to the drum. The plurality of wire cable sections 42 forming the vacuum forming means of the invention have their inner ends 54 fixedly attached to the plates 52 and thereby to the circular drum 44 and have their outer ends 56 positioned within a pressed flat tubing section 58. The wire cables and the elongated pressed flat tubing sections are formed of steel and the tubing sections are pressed on the ends of the wire cables in such a manner as to be able to rotate in the range of approximately 2,500 tp 3,000 revolutions per minute without separating from the ends of the cable. In addition, the tubing sections may have a layer of very hard alloy welded onto the tops to provide greater durability.

Figure 5:
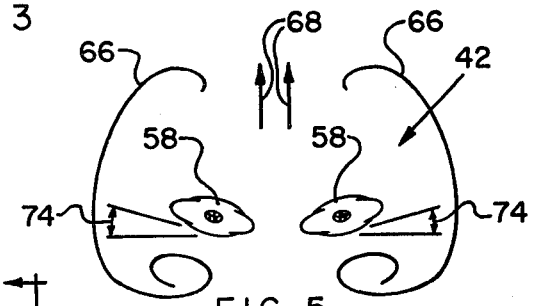
FIG. 5 is an end view, taken along line 5—5 of FIG. 4, showing the pressed flat tubing sections on the ends of the wire cable sections which form, in combination with the rotating wire cable sections, the vacuum forming means of the subject invention.
Figure 6:
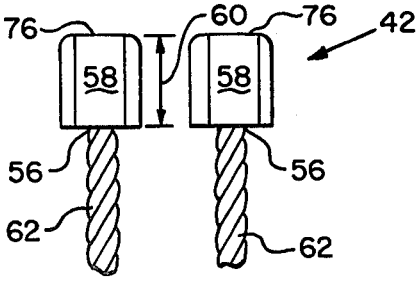
FIG. 6 is a partial side view, taken along line 6—6 of FIG. 4, showing the pressed flat tubing sections applied to the ends of the wire cable sections.

By referring to FIGS. 5 and 6 of the drawings at this time, it can be seen how the pressed flat tubing sections 58 of adjacent pairs of rotating wire cable sections 42 are positioned relative to each other to provide a toe in effect. The pressed flat tubing sections 58 are formed in the embodiment shown of an elongated section of tubing approximately 1 inch long which would be shown by the numeral 60 in FIG. 6 of the drawings. The wire cable sections 62 would be constructed in the embodiment shown of approximately 5/16 inch diameter steel wire cable and would be approximately 5 inches long as shown by the numeral 64 in FIG. 4 of the drawing.

When the tubing sections 58 are pressed flat on the ends of the wire cable 62, they form a substantially blade-like weight on the end of the cable, and when they are toed in in relationship to each other, they aid in creating a swirling action as shown by the curved line 66 in FIG. 5 of the drawing whenever the pressed flat tubing sections 58 are rotating in the direction shown by the arrow 68. The rotational direction of the circular drum 44 is such that the bottom surface of the drum is rotating in a forward direction as the lawn sweeper is moving forward to thereby vacuum the debris up through the open bottom 16 of the sweeper and to throw the debris backwards through the open rear 18 of the sweeper into the collector bin 20. By referring back to FIG. 1 of the drawing, it will be seen that the angle of rotation of the circular drum 44 is shown by means of the arrow 70 while the direction of the lawn sweeper is shown by means of the arrow 72 and it can then be seen the function of the rubber blade 36 in preventing debris from being thrown forward of the housing 12 whenever the lawn sweeper is operated. In an alternative embodiment (not shown) small circular discs may be attached, as by welding, brazing or soldering, at their centers to cable sections 62 to provide improved cutting action when the device is used, for example, as a root leveler.

While in the embodiment shown it is noted that the lawn sweeper 10 is designed with a single pair of wheels 38 mounted rearwardly on the housing 12, it is within the spirit and scope of the invention that a second pair of wheels could be mounted on the forward section and by the use of means known in the arts, the sweeper unit could become self-contained and self-powered. The embodiment shown in FIG. 1 of the drawing is designed to have a bifurcated frame 14 which is attachable to a tractor or some other pulling device.

The angle of the pressed flat tubing section 58 would be approximately 15 degrees from the longitudinal axis of the rotating drum and by referring to FIG. 5 of the drawing, it can be seen this angle shown by the numeral 74 in that drawing view. The adjacent pairs of wire cables are positioned so that their predetermined weights formed from the flat pressed tubing section 58 are angled toward each other approximately 15 degrees from the longitudinal axis of the rotating drum. When formed thusly, the adjacent pairs of pressed flat tubing sections 58 form a substantially V-shape vacuum forming air scoop which aids to form the strong uplift obtainable with the applicant's invention. In the embodiment shown in the drawing, approximately 72 wire cables were fixedly attached to the surface of the rotating circular drum 44 and when the drum rotates in the range of approximately 2,500 to 3,000 revolutions per minute, large amounts of all sizes of debris are capable of being picked up by the lawn sweeper. The ends 76 of the pressed flat tubing sections 58 do not touch the ground and in the embodiment shown have been designed to be positioned approximately 1 inch to 3 inches above the ground level.

Figure 8:
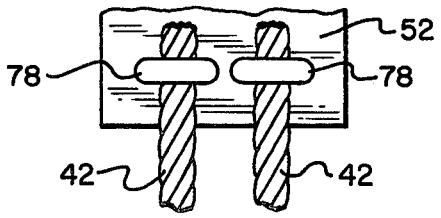
FIG. 8 is a partial side view, taken along line 8—8 of FIG. 4, showing the connection of the wire cables to the plates.
Figure 9:
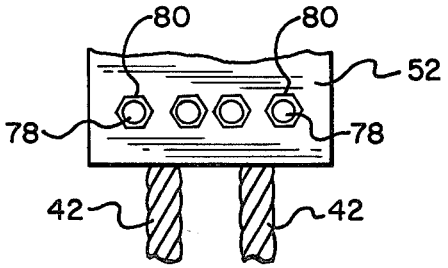
FIG. 9 is a partial side view, taken along line 9—9 of FIG. 4.

By referring now to FIGS. 8 and 9 of the drawing there can be seen the detail of the application of the rotating wire cables 42 to the plates 52. When attached as shown in FIGS. 8 and 9, a U bolt 78 is positioned around the steel wire cables 42 and through a plurality of holes in the plates 52. The holes are not shown in FIGS. 8 and 9 and would preferably be drilled in the plates 52 prior to the plates being welded to the steel circular drum 44. The U bolt 78 would tightly grip the rotating wire cables 42 and would be held in place by means of a plurality of nuts 80 and associated lock washers (not shown in the drawing).

Figure 2:
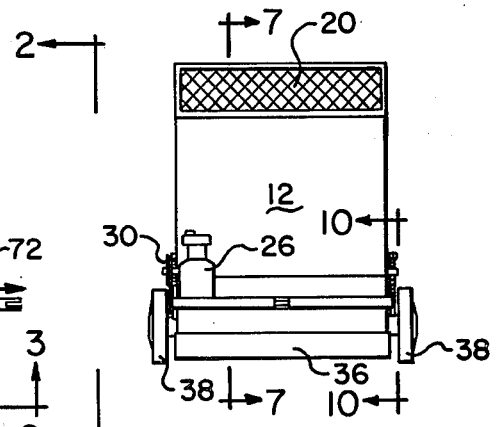
FIG. 2 is an end view, taken along line 2—2 of FIG. 1.
Figure 7:
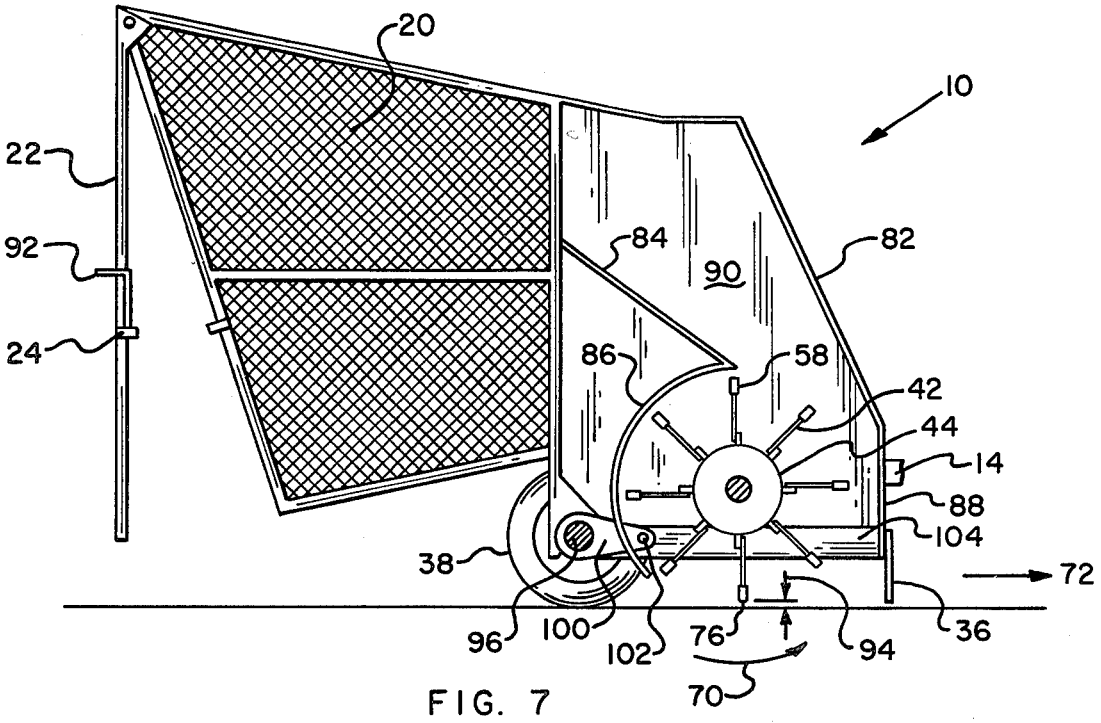
FIG. 7 is a partial sectional view, taken along line 7—7 of FIG. 2, showing the interior of the lawn sweeper and the housing.

Referring now to FIG. 7 of the drawing there is shown a partial sectional view, taken along line 7—7 of FIG. 2, showing the interior of the lawn sweeper and especially showing in detail the interior of the housing 12. The housing 12 is formed having a sloping front 82 and a sloping rear 84 in combination with a curved rear portion 86 and a straight front portion 88. The portions 82, 84, 86 and 88, form the vacuum chamber 90 in which the steel circular drum 44 rotates with its attached plurality of rotating wire cables 42. As previously mentioned the rotation of the steel circular drum 44 is in the direction shown by the arrow 70 whenever the sweeper 10 is being pulled by the direction shown by the arrow 72.

It can then be seen that any debris picked up by the vacuum created by the rotating wire cables 42 will be deposited within the chamber 90 and will be thrown backwardly into the collector bin or cage 20 where it can ultimately be removed through the pivotable door 22. The door 22 is shown is FIG. 7 in the open position with the latch 24 being opened by means of lifting the pin 92 from the latch.

As has been mentioned before, the wheels 38 are designed so that they may be adjustable upwardly and downwardly so that the ends 76 of the pressed flat tubing sections 58 may be raised and lowered above the ground level. In the embodiment shown it is preferable to position the ends 76 a distance of from approximately one to three inches above the ground level as shown by the arrow distance 94 in FIG. 7 of the drawing. When positioned at this distance, the pressed flat tubing sections 58 operate at a maximum efficiency and operate with extremely long life.

Figure 10:
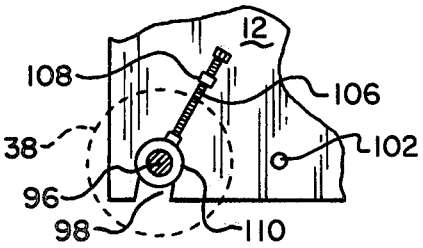
FIG. 10 is a partial side view, taken along line 10—10 of FIG. 3, showing the adjustable feature on the wheels of the subject invention.

By referring now to FIGS. 7 and 10 of the drawing there is shown how the wheels 38 may be designed for adjustment upwardly and downwardly. The wheels 38 are carried by a single shaft 96 which is positioned within a notch 98 in the housing side 12. The shaft 96 is also carried by a plurality of plates 100 which are pivotably mounted by means of a pair of pins 102 in a frame section 104 attached to the main sweeper frame 14. It can be seen then that the wheels 38 are free to ride up and down in the notch 98. In order to control the motion of the wheels 38 in the notch 98, there has been provided an adjusting screw 106 which is positioned in an adjusting nut 108 which has been welded to the housing sides 12. The adjusting screw 106 and its companion adjusting nut 108 have been referred to previously in the specification as an adjusting connection 40 and are shown in FIG. 1 of the drawing.

The ends of the adjusting screw 106 are welded to a circular plate 110 which is positioned around the shaft 96 as shown in FIG. 10 of the drawing. It thus becomes apparent that whenever the adjusting screw 106 is rotated in the adjusting nut 108, the wheels 38 and their attached shaft 96 will move upwardly or downwardly a predetermined amount within the notch 96 in order to set the desired height 70 of the ends 76 of the pressed flat tubing sections 58.

From the foregoing it can be seen that there has been provided by the subject invention an improved lawn sweeper having an improved vacuum section which is capable of clearing large amounts of all sizes of accumulated debris from the area over which the sweeper is operated. It should become apparent from a review of the drawings and from a reading of the specification, that many changes may be made in the parts of the invention without departing from the spirit and scope of the invention and the invention is not to be limited to the exact embodiment shown which has been shown only for illustration purposes.

Having described by invention, I claim:

1. A lawn sweeper for clearing a lawn of accumulated debris such as leaves, pine straw and the like, comprising:

(a) a housing comprising, in part, a frame and having a bottom opening and a discharge opening having attached thereto a collector bin;

(b) a rotatable base positioned within the housing and supported on an axis of rotation about an at least generally horizontal axis and over the bottom opening and substantially above ground level;

(c) vacuum forming means, associated with the rotatable base for forming a vacuum within the housing and over the bottom opening above the lawn area to be cleared, the vacuum forming means comprising, in part, a plurality of spaced wire cable sections, having inner ends fixedly attached to the base and having outer ends radially extending from said base and further comprising, in part, lateral extention blade means positioned on said wire cable sections and extending out from at least one side of said cable section, said cable sections with said lateral extention blade means extending radially out from said base a distance less than the separation difference between the base and the ground level, thereby being out of contact with the ground as said base rotates;

(d) drive means, associated with the rotatable base and the housing, for rotating the base with its vacuum forming means as the lawn sweeper is moving forward to vacuum the debris up through the bottom opening and backwards through the discharge opening into the collector bin; and (e) a plurality of ground support means mounted on the housing for carrying the housing and the lawn sweeper along the lawn.

2. The lawn sweeper as defined in claim 1 wherein the means for rotating the drum comprises, in part, a gasoline engine mounted to the housing frame.

3. The lawn sweeper as defined in claim 1 wherein said blade means comprises a section of tubing pressed radially down on the outer end of the wire cable section.

4. The lawn sweeper as defined in claim 3 wherein the section tubing is approximately 1 inch long.

5. The lawn sweeper as defined in claim 4 wherein the wire cable section and the section tubing are formed of steel and the tubing is pressed on the end of the cable to rotate in the range of approximately 2,500 to 3,000 revolutions per minute without separating from the end of the cable.

6. The lawn sweeper as defined in claim 1 wherein the vacuum forming means comprises, in part, approximately 72 wire cable sections fixedly attached to the surface of the drum.

7. The lawn sweeper as defined in claim 1 wherein the rotatable drum is adjustably mounted with respect to the ground level so that the vacuum forming means associated with the rotatable drum can be positioned above the lawn a pre-determined distance.

8. The lawn sweeper as defined in claim 7 wherein the pre-determined distance above the lawn is approximately in the range of 1½ inches to 2 inches.

9. The lawn sweeper as defined in claim 1 wherein the wire cable section is approximately 5/16 inches in diameter and is approximately 5 inches long.

10. The lawn sweeper as defined in claim 1 wherein said blade means defines an extended lateral surface making an acute angle with respect to the axis of rotation of said drum.

11. The lawn sweeper as defined in claim 10 wherein the angle of the blade means is approximately 15°.

12. The lawn sweeper as defined in claim 10 wherein adjacent pairs of wire cables are positioned in close proximity with their angled blade means surface angled towards each other and directed rearwardly with respect to the direction of rotation of said cable sections.

13. The lawn sweeper as defined in claim 12 wherein the blade means comprise sections of tubing pressed radially down on the outer ends of the wire cable sections and the angling of the adjacent pairs of blade means forms a V-shape vacuum forming air scoop.

* * * * *